United States Patent [19]

Heft

[11] 4,011,420

[45] Mar. 8, 1977

[54] MOLDED CASE CIRCUIT BREAKER WITH IMPROVED INTERRUPTING CAPACITY

[75] Inventor: Eldon Bertel Heft, West Hartford, Conn.

[73] Assignee: General Electric Company, New York, N.Y.

[22] Filed: Jan. 22, 1975

[21] Appl. No.: 543,134

[52] U.S. Cl. ..... 200/147 R; 200/144 R; 335/201

[51] Int. Cl.[2] ..... H01H 9/34

[58] Field of Search ..... 335/201; 200/144 C, 200/146 R, 147 R, 306, 147 B, 144 R

[56] References Cited

UNITED STATES PATENTS

| | | | |
|---|---|---|---|
| 3,089,936 | 5/1963 | Smith, Jr. | 200/147 R |
| 3,422,235 | 1/1969 | Camp | 200/147 R |
| 3,464,040 | 8/1969 | Powell | 335/191 |
| 3,564,176 | 2/1971 | Fechant | 200/144 R |
| 3,707,612 | 12/1972 | Yorgin | 200/306 |

*Primary Examiner*—Gerald P. Tolin
*Attorney, Agent, or Firm*—Robert A. Cahill; Walter C. Bernkopf; Frank L. Neuhauser

[57] ABSTRACT

A molded case circuit breaker of relatively narrow width is afforded dramatically increased current interrupting capacity by providing shielding against the electromagnetic field developed as the result of short circuits flowing through a contiguous circuit breaker. Additionally, an arc runner is added to cooperate with an improved arc chute construction in controlling to extinction the arc developed incident to an interruption. The case is also vented to relieve the internal gas pressure during arcing.

3 Claims, 2 Drawing Figures

MOLDED CASE CIRCUIT BREAKER WITH IMPROVED INTERRUPTING CAPACITY

BACKGROUND OF THE INVENTION

The present invention is an improvement over the electric circuit breaker construction disclosed and claimed in U.S. Pat. No. 3,464,040, assigned to the assignee of the instant application. This patented construction provides a molded case circuit breaker of relatively narrow width, in practice, one-half inch wide, in answer to the demand for more compact circuit breaker load centers. Thus, utilization of half-inch wide circuit breakers in place of conventional one-inch wide circuit breakers affords a significant reduction in the load center size for the same number of branch circuits or, conversely, a significant increase in the number of branch circuits accommodated by a given load center size.

Unfortunately, with the reduction in circuit breaker width, the task of successfully interrupting short circuit currents becomes increasingly more formidable. This situation is further magnified by the current trend of electrical utilities to increase the "current available". The current available is the magnitude of current which potentially could flow in a circuit experiencing a short circuit. Whereas current availables of 5,000 amperes for residential electrical service were standard in the past, utilities are currently establishing current availables of 10,000 amperes and up for new installations. As a consequence, circuit breakers of higher interrupting capacity (IC) ratings must be installed. The current trend is to even higher current availables, calling for more expensive circuit breakers having higher IC ratings.

Interruption of such potentially higher short circuit current magnitudes places tremendous mechanical stresses on a circuit breaker. First, the circuit breaker must absorb the tremendous energies associated with interrupting the current flowing through its internal circuit. Secondly, in a two-pole circuit application, where one circuit breaker is side-by-side with another circuit breaker also endeavoring to interrupt the same short circuit current flowing in the opposite direction in its internal circuit, each must also withstand the forces exerted on its current carrying parts by the electromagnetic field associated with the current flow through the other. These forces have been known to dislodge parts of the circuit breaker and even impact them against the breaker case with rupturing force. Under these circumstances, even in the remote chance that the short circuit is successfully cleared, the circuit breaker is nevertheless irreparably damaged and must be replaced.

It is accordingly an object of the present invention to provide an electric circuit breaker of the above character wherein increased interrupting capacity is achieved without increasing the physical size of the circuit breaker.

Yet another object is to provide a circuit breaker of the above character, wherein increased interrupting capacity is achieved with only minimal, but nevertheless significant, structural changes to an existing circuit breaker design.

A further object is to provide a circuit breaker of the above character which is inexpensive to manufacture, and yet is efficient and reliable in operation.

Other objects of the present invention will in part be obvious and in part appear hereinafter.

SUMMARY OF THE INVENTION

In accordance with the present invention, there is provided a molded case circuit breaker of relatively narrow width having dramatically increased current interrupting capacity to accommodate the trend toward higher current availables. As will be seen, the circuit breaker of the instant invention is uniquely equipped not only to handle the interruption of higher magnitude short circuit currents, but also to withstand the mechanical forces associated with the electromagnetic field generated by short circuit currents flowing through an adjacent circuit breaker, such as in the situation where separate, side-by-side circuit breakers are utilized in a two-pole circuit configuration. Moreover, the structural features of the invention contributing to higher interrupting capacities can be readily implemented in existing circuit breaker designs.

More specifically, one aspect of the invention is to provide shielding for the current carrying portion of an elongated, pivotal contact arm of one circuit breaker from electromagnetic fields generated as the result of high amplitude currents flowing in an adjacent circuit breaker. In the disclosed embodiment of the invention this shielding is economically achieved by providing enlarged magnetic arc chute side plates between which the current carrying portion of the contact arm swings during an interruption. These side plates serve quite effectively to mitigate the mechanical influence of the electromagnetic field created by current flowing in the internal circuit of one breaker on the contact arm of another, adjacent circuit breaker, and vice versa.

Since complete shielding in this manner is not practical, the contact arm of the circuit breaker is influenced by the electromagnetic field from the associated circuit breaker of a two-pole configuration during a short circuit interruption, albeit to a lesser degree. Accordingly, another feature of the invention further contributing to improved interrupting capacity involves reducing the spacing between the contact arm and the cover sidewall of the circuit breaker case. This reduces the kinetic energy buildup of the contact arm as it moves into impact with the cover sidewall, thus preventing damage thereto. Moreover, the lower portion of the contact arm is laterally offset into closely spaced relation with the magnetic arc chute sideplate adjacent the opposite or base sidewall. The electromagnetic field associated with the current flow through the contact arm of one breaker produces a force biasing its terminal portion toward this contiguous arc chute sideplate, which is in a direction opposite to the force associated with the electromagnetic field developed by the adjacent breaker acting on the upper portion of the contact arm.

To enhance the ability to handle the tremendous energies involved in a short circuit interruption, the circuit breaker of the invention is provided with means for better controlling and extinguishing the violent arc accompanying the interruption. To this end, an arc runner is positioned in the arc chamber to depend downwardly from the fixed contact toward the bottom wall of the circuit breaker case. The arc chute is provided with a raised, conductive frontal portion positioned in close proximity to the arcuate path the movable contact takes as it is moved by the contact arm away from the fixed contact. A second arc runner depends form this frontal arc chute portion toward the case bottom wall. This raised frontal arc chute portion is effective, as the movable contact swings by, to divide the elongating arc between the fixed contact and movable contact into two arcs--one between the fixed contact and this frontal arc chute portion and the other between the frontal arc chute portion and the receding movable contact. The former arc propagates downwardly along the two arc runners to the bottom wall of the case where it ultimately extinguishes. The bottom wall is provided with a vent opening at a location between the lower terminations of the two arc runners to relieve the high pressure associated with this arc. The foot point of the second arc, initially at the raised frontal arc chute portion, moves rearwardly along a conductive base of the arc chute as the movable contact continues moving away. The case is vented just beyond the arc chute where this second arc extinguishes to relieve the associated high gas pressures.

While it is discovered that less than all of these structural improvements can be implemented to improve the interruption capacity of residential, molded case circuit breakers, it is found that the implementation of all of these structural improvements has a synergistic effect in dramatically increasing the interruption capacity.

The invention accordingly comprises the features of construction, combination of elements, and arrangement of parts which will be exemplified in the construction hereinafter set forth, and the scope of the invention will be indicated in the claims.

For a fuller understanding of the nature and objects of the invention, reference should be made to the following detailed description taken in connection with the accompanying drawing, in which:

FIG. 1 is a side elevational view of an automatic electric circuit breaker embodying the present invention with the cover of the breaker case removed to illustrate the internal construction; and FIG. 2 is a sectional view taken along line 2—2 of FIG. 1.

Like reference numerals refer to corresponding parts throughout the several views of the drawing.

DETAILED DESCRIPTION

Figure 2:
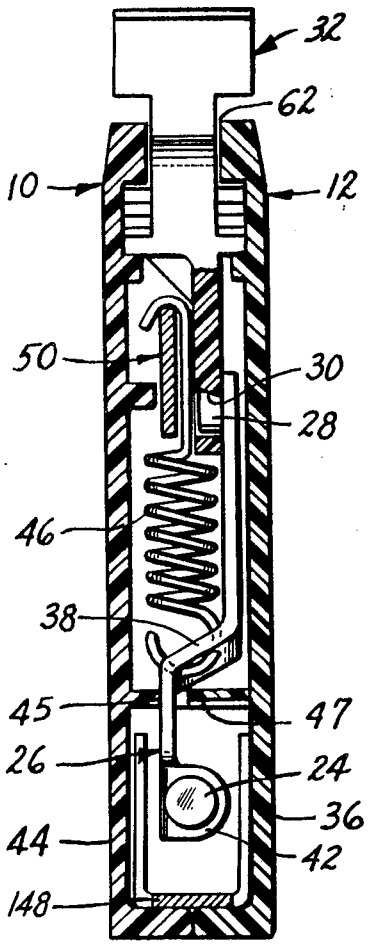

The current structural improvements giving rise to the dramatic increase in current interruption capacity are illustrated in the drawing as being implemented in a half-size residential molded case circuit breaker of the construction disclosed and claimed in U.S. Pat. No. 3,464,040 issued to D. B. Powell and assigned to the assignee of the instant application. The disclosure of this patent is specifically incorporated herein by reference.

Referring to the drawing herein, an electric circuit breaker embodying the present invention is provided with a molded insulating case consisting of a base 10 and an interfitting cover 12 secured together by fasteners (not shown) seated in registered apertures 14 therein. The base and cover are formed with interior surface configurations providing ribs, shoulders, apertures and recesses for mounting the various circuit breaker internal parts, as fully disclosed in the above-noted patent.

At the front end of the case is a line terminal, generally indicated at 16 and including a U-shaped conductive line strap 17 backed by a conductive stab member 18. These parts have flared terminations extending through an aperture in the lower front corner of the circuit breaker case to provide clamping jaws biased together by spring 20 for plug-on electrical contacting engagement with a stab blade of a panelboard or the like (not shown). The line terminal strap 17 and stab member 18 fit over a shoulder or rib 21 formed in both the base and cover of the circuit breaker case. The termination of the line strap within the breaker case mounts a stationary contact 22.

A movable contact 24 is carried at the lower end of a contact arm, generally indicated at 26, for movement between an open circuit position remote from stationary contact 22 and a closed circuit position in electrical contacting engagement with the stationary contact. As best seen in FIG. 2, contact arm 26 is fabricated from sheet metal to minimize the breaker width and has a laterally extending finger 28 at its upper end lodged in an aperture 30 formed in the lower portion of an operating handle, generally indicated at 32. The upper portion of the contact arm is generally planar and lies adjacent cover sidewall 36 below and to the side of operating handle 32. Intermediate its length, the contact arm is provided with an offset portion 38 such that the lower contact arm portion is disposed in closer proximity to the base sidewall 44 than to the cover sidewall 36. The terminal portion of the contact arm carries an extension 42 which is turned laterally so as to mount the movable contact 24 in the appropriate orientation for contact closure with stationary contact 22. Again as best seen in FIG. 2, a mechanism spring 46 has its lower end hooked in apertures provided in the offset portion 38 of the contact arm and its upper end hooked on a cradle, generally indicated at 50. The spring 46 operates in tension and applies upward pressure on the contact arm, thus assuring rapid snap action contact closure and contact separation produced by digital movement of the operating handle 32 pivotally mounted in the circuit breaker case.

Figure 1:
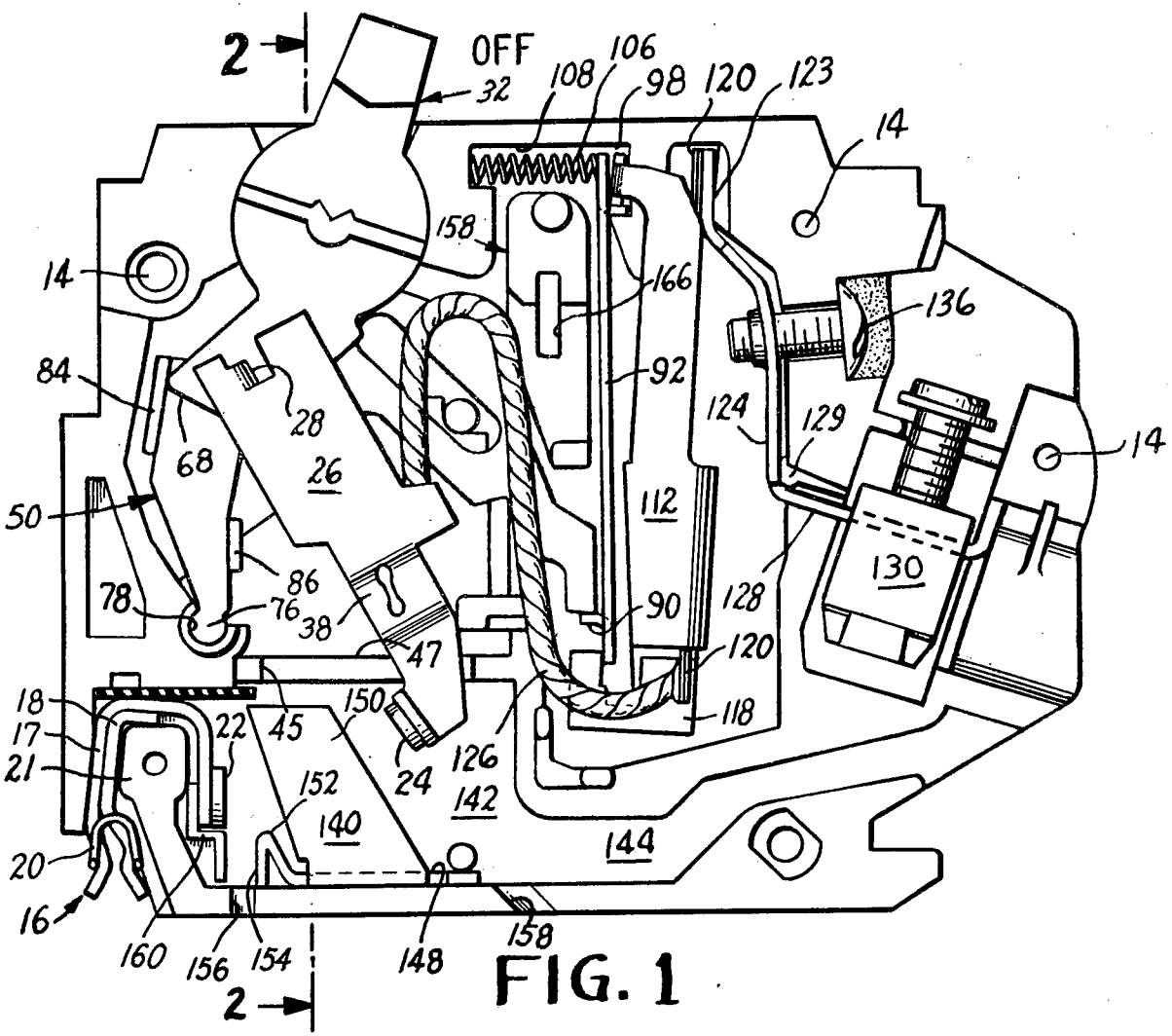

Cradle 50 is likewise a relatively thin member disposed between the operating handle 32 and base sidewall 44. This cradle, as more clearly disclosed in the above-noted U.S. Pat. No. 3,464,040, is generally of an inverted U-shaped configuration with one leg terminating in a generally circular end portion 76 pivotally retained in a cooperatively configured recess 78 formed in base 10. The termination of the other leg of cradle 50 normally engages a tab 90 struck from the lower end portion of a latch member, generally indicated at 92, in the operating or untripped condition of the breaker. The upper end of member 92 is pivotally mounted in a recess 98 formed in each of the base 10 and cover 12 of the circuit breaker case. A spring 106 captured in case recess 108 acts on the upper end of the latch member 92 to urge the lower end of the latch member to the left, as seen in FIG. 1, so as to position tab 90 in latching engagement with cradle 50. Also pivotally mounted in recess 98 is the upper end of a magnet member, generally indicated at 112. The lower portion of this magnet member is formed in partial embracing relation with a bimetal 120 connected at its lower end to contact arm 26 by a braid 126. The upper end of bimetal 120 is secured to and mounted by the upper end 123 of a terminal strap 124 which extends downwardly and outwardly through an opening 129 in the circuit breaker case to a load terminal, generally indicated at 130. Also secured to the lower end of bimetal 120 is a hook 118 which extends forwardly under the lower termination of latch member 92 and upwardly into intercepting relation with the latch member.

From the foregoing description, it is seen that, under overload conditions, the lower end of bimetal 120 deflects to the right as seen in FIG. 1, and, via hook 118, pulls the lower end of latch member 92 also to the right. Tab 90 is removed from latching engagement with cradle 50 and the circuit breaker trips. Under short circuit conditions, the current flowing through the internal circuit breaker series circuit including bimetal 120 produces sufficient magnetic flux in the magnet member 112 to attract latch member 92, thereby unlatching cradle 50 and causing the circuit breaker to trip. To calibrate the overload trip setting, a screw 136 mounted in the circuit breaker case and threadedly engaging load strap 124 is turned to adjust the disposition of bimetal 120.

The detailed description thus far is essentially a summary of the descriptive portion of the above-noted U.S. Pat. No. 3,464,040. Thus, for a full understanding of the details of construction, reference can be made to this patent.

In accordance with the present invention, there is provided improved structure for controlling to extinction an arc drawn between the contacts 22, 24 during separation to interrupt short circuit current and for dissipating the heat and high gas pressures associated therewith. To this end, an improved arc chute 140 is positioned in an arc chamber 142 which is vented to the atmosphere by a rearwardly extending channel 144 molded in the base and cover sections of the circuit breaker case. The arc chamber is effectively isolated from the case compartment accommodating the operating mechanism by a barrier 47. Contact arm 26 extends through an elongated slot 45 in this barrier, thus accommodating the swinging motion of the contact arm between closed circuit and open circuit positions. Arc chute 140 is formed of magnetic metal having a base 148 positioned against the bottom wall of the circuit breaker case and vertically elongated sideplates 150 extending upwardly along the sidewalls of the base and cover for essentially the entire height of the arc chamber 142. The front portion of the arc chute base 148 is turned upwardly to provide a raised frontal portion 152. Turned downwardly from this raised frontal portion is a depending arc runner 154 which terminates adjacent the floor or bottom wall of the circuit breaker case. Just forwardly of this arc runner the case bottom wall is provided with a vent opening 156 molded in the base and cover sections of the circuit breaker case. In addition, a slanted vent opening 158 is provided in the case bottom wall just rearwardly of the arc chute base 148.

The line terminal configuration is modified so as to provide a two-piece construction rather than the one-piece construction shown in Pat. No. 3,464,040. That is, line strap 17 and stab member 18 are not formed as a continuous strip folded back on itself as in the patented design. Rather, as seen in FIG. 1, stab member 18 terminates at the top of shoulder 21, so as to thus provide a single current path exclusively through line strap 17 between the line terminal jaws and stationary contact 22. As will be elaborated on below, the establishment of this single current path affords more positive control of the arc drawn between the stationary and movable contacts during a short circuit interruption.

Completing the structural improvements provided by the instant invention, an arc runner 160 of somewhat Z-shaped configuration is welded at its upper vertical portion in electrical contact with the side of line strap 17 opposite from stationary contact 22. The intermediate portion of this arc runner extends horizontally beneath the termination of the line strap and the stationary contact with a lower vertical portion depending therefrom to a termination adjacent the case bottom wall at a location just forwardly of vent opening 156 therein.

These structural improvements are found to act synergistically to increase the interruption capacity of a circuit breaker otherwise constructed in accordance with U.S. Pat. No. 3,464,040 from 5,000 amps to 22,000 amps, a dramatic increase of more than fourfold. Even more remarkable is the fact that this higher interruption capacity is achieved in a 120/240-volt circuit protected by two physically side-by-side circuit breakers of the disclosed construction connected in a two-pole configuration. Under these circumstances, the high short circuit current flows through the internal circuits of both circuit breakers in respectively opposite directions. Thus, the electromagnetic field developed by the current flow through each breaker creates mechanical forces on the current carrying parts of the other circuit breaker, particularly that elongated portion of each contact arm 26 between the movable contact 24 and the location of attachment of the braid 126 thereto. These forces act in opposite directions on the contact arms to force them apart.

In accordance with the present invention, the effects of these external electromagnetic fields on the contact arms are mitigated by vertically elongating the arc chute wings or sideplates 150 to substantially the entire height of the arc chamber 142. These arc chute sideplates thus become effective as barriers shielding the lower current carrying portion of the contact arm 26 from the influence of the electromagnetic field developed by current flow through the adjacent breaker. As seen from FIG. 1, this shielding is effective along a substantial portion of the path of movement of the contact arm away from the stationary contact during a short circuit interruption.

It will be appreciated that this shielding of the current carrying portion of the contact arm 26 is not complete, partly due to the fact that some of the contact arm current carrying portion extends above the arc chamber 142. Thus, the force of the electromagnetic field developed by current flow in one breaker is exerted on the contact arm of the other contiguous breaker, and vice versa, albeit to a lesser degree. To insure that these forces do not engender destructive consequences, it is a feature of the present invention to reduce the spacing between the upper portion of the contact arm and the cover sidewall 36. This is most practically achieved by thickening the cover sidewall. In an operative embodiment of the present invention, the spacing between the contact arm and the cover sidewall was reduced by one-third, from 0.015 to 0.005 inches. This reduces the force of impact of the contact arm against the cover sidewall by a factor of three. A collateral benefit is that the cover is made stronger by thickening its sidewall. Thus, by virtue of the instant invention, impact of the contact arm with the cover sidewall is incapable of fracturing or otherwise damaging the cover sidewall. This is in contrast with circuit breakers constructed in accordance with the above-noted patent, wherein the typical consequence of subjecting such breakers in a two-pole configuration to short circuit currents exceeding their interrupting capacity is that the contact arm of one breaker impacts against its cover sidewall with rupturing force.

Considering an identical circuit breaker juxtaposed to the left of the one shown in FIG. 2, it will be appreciated that its contact arm 26 is normally biased by the mechanism spring 46 against the left edge of slot 45 in barrier 47. The electromagnetic field resulting from current flow through the contact arm of the right pole circuit produces a force on the left pole contact arm which merely increases this bias. Since this contact arm is constrained by the barrier 47 against movement to the left away from the right pole circuit breaker, it cannot impact against the base sidewall 44 and thus the possibility of damage thereto is precluded.

Also mitigating against the force propelling contact arm 26 into impact with the cover sidewall 36 is the fact, as best seen in FIG. 2, that the lateral offset imparted to the contact arm brings its lower terminal portion into close proximity with the arc chute sideplate 150 upstanding along the base sidewall 44. The short circuit current flowing through this terminal portion of the contact arm generates an electromagnetic field which, with the close proximity of this magnetic arc chute sideplate, produces a force acting on the lower end portion of the contact arm in the direction of the case sidewall 44. It is seen that this force, being in the opposite direction from that force developed on the upper portion of the contact arm by the electromagnetic field from the left pole breaker, further mitigates the force of impact of the contact arm against the cover sidewall 36.

Turning now to the structural features of the instant invention contributing to the improved control to extinction of the arc drawn between the fixed and movable contacts during a short circuit interruption. As previously described, line strap 16 constitutes the sole current path between the line terminal and fixed contact 22. Under these circumstances, the direction of this current path is always downwardly to the fixed contact. This is contrasted with the construction shown in U.S. Pat. No. 3,464,040, wherein the stab member 18 was provided by folding the line strap back on itself, thus providing two parallel current paths between the line stab terminal 16 and fixed contact 22. Under these circumstances, it is quite possible to have unequal currents flowing in these two current paths. If the current in the stab member is greater than that flowing through the line strap, there will be a predominance of current flowing through the fold in the line strap and over a path directed upwardly to the fixed contact. Because of the interaction of the associated magnetic fields, the path of an arc leaving stationary contact 22 is forced into general alignment with the path of the current flowing to or from the stationary contact. Thus, with the patented line strap construction, if the predominant current flow to or from the stationary contact is over the upwardly directed path to the stationary contact, the path of the arc leaving the stationary contact will start out in an upwardly direction. Under these circumstances, it is difficult for the arc chute 140 to gain control of the arc. With the improved construction of the present invention, wherein stab member 18 terminates short of the stationary contact 22, it is seen that the only current path to or from the stationary contact is directed downwardly through line strap 17. Thus, the path of the arc extending from the stationary contact is always downwardly and generally toward arc chute 140. Thus, the arc chute can readily gain control of the arc drawn between the stationary contact and the movable contact 24 as the latter is moved away during a short circuit interruption.

As movable contact 24 swings past the raised frontal portion 152 of arc chute base 148, the elongating arc drawn between the stationary and movable contacts is split up into two arcs; the first extending between the stationary contact and the raised frontal portion 152 and the second extending between this raised frontal portion and the receding movable contact 24. The foot points of the first arc progress down the arc runners 154 and 160, thus controllably moving the arc downwardly toward the bottom wall of the circuit breaker case where it ultimately extinguishes. Since the terminations of these two arc runners straddle the vent opening 156 in the bottom wall of the circuit breaker case, the high gas pressures associated with this first arc are relieved through this vent opening to the atmosphere without damage to the circuit breaker case.

As the movable contact 24 continues moving away from the raised frontal portion 152 of the arc chute base 148, the foot point of the elongating second arc, originally established at the raised frontal portion 152, moves downwardly onto the arc chute base 148 and rearwardly over its surface of the termination where extinction is achieved. The high pressures associated with this second arc are relieved through the vent channel 144 and through the vent opening 158 in the case floor just rearwardly of arc chute 140.

From the foregoing description, it is seen that with relatively slight and yet significant modifications to the structure shown in the above-noted U.S. Pat. No. 3,464,040, a dramatic increase in interruption capacity is achieved. This increase is achieved economically and without resort to stronger, more expensive case materials. It will be understood that less than all of these structural modifications can be implemented to increase interruption capacity to a lesser extent. However, it is found that the implementation of all of these structural improvements has a synergistic effect of increasing the interruption capacity of a circuit breaker otherwise constructed in accordance with the above-noted patent from 5,000 amperes to 22,000 amperes, an increase in excess of four-fold. This extraordinarily high interruption capacity is achieved even in the most rigorous application, namely, with two such circuit breakers in physical side-by-side relation connected in a two-pole configuration.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawing shall be interpreted as illustrative and not in a limiting sense.

Having described the invention, what is claimed as new and desired to secure by Letters Patent is:

1. An electric circuit breaker comprising, in combination:

A. a molded insulative case having top and bottom walls and opposed end and sidewalls;

B. an arc chamber formed in said case adjacent said bottom wall;

C. an operating mechanism including 1. an operating handle pivotally mounted by said case and having an externally accessible handle portion extending through an opening in said case top wall, and 2. an elongated contact arm within said case pivotally connected adjacent its upper end to said handle and extending downwardly to a termination located within said arc chamber, an elongated portion of said arm above said arc chamber disposed in intimately spaced relation to one of said case sidewalls;

D. a first contact affixed to said contact arm adjacent said termination thereof;

E. a second contact fixedly positioned in said arc chamber for engagement by said first contact when said arm is pivoted to a closed circuit position;

F. a magnetic conductive arc chute disposed in said arc chamber, said arc chute having 1. a base lying adjacent said case bottom wall,
2. sideplates extending upwardly along each case sidewall to substantially the full height of said arc chamber with upper terminations located well-above the level of said first contact while in its position of engagement with said second contact, said sideplates shielding the terminal current carrying portion of said contact arm from external magnetic fields penetrating the case of sidewalls, and
3. a raised, conductive frontal portion extending upwardly from said base toward said second contact and into proximity with the path of movement of said first contact away from said second contact;

G. a first arc runner extending downwardly from said chute raised frontal position to a termination adjacent said case bottom wall;

H. a second arc runner electrically connected to said second contact and extending downwardly therefrom in spaced relation to said first arc runner to a termination adjacent said case bottom wall; and I. means forming a vent opening in said case bottom wall at a location intermediate said first and second arc runner terminations.

2. The electric circuit breaker defined in claim 1, which further includes a line strap extending into said arc chamber in a downwardly direction to dispose a butt end thereof in spaced relation to said case bottom wall, said second contact affixed to said strap adjacent to said butt end, whereby current flowing to said second contact through the portion of said strap within said arc chamber is exclusively along a vertical path, said second arc runner affixed to said strap adjacent said butt end and extending downwardly therefrom.

3. The circuit breaker defined in claim 2, which further includes a second vent opening in said case bottom wall at a location beyond the opposite end of said base from the location of said first vent opening.

* * * * *